US008719118B2

(12) United States Patent
Hacker

(10) Patent No.: US 8,719,118 B2
(45) Date of Patent: May 6, 2014

(54) METHOD FOR MANAGING DRILLING PIPES, DRILLING TOOLS, WELL TUBING, AND THE LIKE IN GROUND DRILLING

(75) Inventor: Christian Hacker, Sasbach (DE)

(73) Assignee: KEURO Besitz GmbH & Co. EDV-Dienstleistungs KG, Achern (DE)

( * ) Notice: Subject to any disclaimer, the term of this patent is extended or adjusted under 35 U.S.C. 154(b) by 0 days.

(21) Appl. No.: 13/616,075

(22) Filed: Sep. 14, 2012

(65) Prior Publication Data

US 2013/0087387 A1 Apr. 11, 2013

(30) Foreign Application Priority Data

Oct. 7, 2011 (EP) ..... 11008154

(51) Int. Cl.
*G06Q 10/00* (2012.01)

(52) U.S. Cl.
USPC ..... 705/28; 705/30; 700/115; 700/227; 700/229; 166/228; 235/376; 340/10.34

(58) Field of Classification Search
USPC ..... 705/28; 700/115, 227; 166/228; 235/376
See application file for complete search history.

(56) References Cited

U.S. PATENT DOCUMENTS

| | | | | |
|---|---|---|---|---|
| 4,042,123 | A | 8/1977 | Sheldon et al. | |
| 4,153,120 | A * | 5/1979 | Zuvela et al. | 175/57 |
| 4,725,179 | A | 2/1988 | Woolslayer et al. | |
| 5,123,547 | A | 6/1992 | Koch | |
| 6,550,547 | B1 * | 4/2003 | Payne et al. | 175/24 |
| 6,601,043 | B1 * | 7/2003 | Purcell | 705/26.35 |
| 2003/0150909 | A1 * | 8/2003 | Markham et al. | 235/376 |
| 2004/0108108 | A1 * | 6/2004 | Bailey et al. | 166/242.6 |
| 2005/0080509 | A1 | 4/2005 | Rippolone | |
| 2007/0124220 | A1 * | 5/2007 | Griggs et al. | 705/28 |
| 2010/0012320 | A1 * | 1/2010 | Vail, III | 166/285 |
| 2010/0104401 | A1 | 4/2010 | Hopkins et al. | |
| 2010/0239404 | A1 | 9/2010 | Blanchard et al. | |

FOREIGN PATENT DOCUMENTS

| | | |
|---|---|---|
| DE | 3333584 | 4/1984 |
| DE | 202010002573 | 8/2010 |
| EP | 0415265 A1 | 3/1991 |
| WO | 2011018614 | 2/2011 |
| WO | 2011120627 A2 | 10/2011 |

OTHER PUBLICATIONS

Kennett, B.J. et al., "The Design of an Automated Drilling Rig: RA-D", Proceedings of SPE/IADC Drilling Conference, Jan. 1, 1991, pp. 221-228.

* cited by examiner

*Primary Examiner* — Vanel Frenel
(74) *Attorney, Agent, or Firm* — Volpe and Koenig, P.C.

(57) ABSTRACT

A method for managing drilling rods, drilling tools, well—tubing and the like for ground drilling, particularly for exploring deposits of fossil fuels or geothermal reservoirs. An electronic data processing system stores information regarding the inventory and the present storage location of parts to be inserted into the well, such as drilling rods, drilling pipes, lining tubing, intermediate parts, drill bits, and the like, with additional information being saved in the computing system regarding the installation position and/or installation sequence of all parts inserted into the well so that the computing system can indicate to a user when and from where which part shall be fed to the well hole—supply system and/or to what location which part shall be returned to for storage when it must be removed from the well, and/or the computing system controls an automatic storage, supply, and restorage device.

10 Claims, 5 Drawing Sheets

METHOD FOR MANAGING DRILLING PIPES, DRILLING TOOLS, WELL TUBING, AND THE LIKE IN GROUND DRILLING

CROSS-REFERENCE TO RELATED APPLICATIONS

This application claims the benefit of European Patent Application No. 11 008 154.4, filed Oct. 7, 2012, which is incorporated herein by reference as if fully set forth.

BACKGROUND

The invention relates to a method for managing drilling pipes, drilling tools, well tubing, and the like for ground drillings, particularly for accessing deposits of fossil fuels or geothermal reservoirs.

In order to explore and access petroleum and natural gas deposits generally ground drilling is required to considerable depths, because the drills must penetrate low-lying layers of rock or the operation occurs off-shore. The same applies for drilling in order, for example, utilizing natural geothermal water reservoirs for energy generation or accessing $CO_2$-deposits.

In all these cases the drilling heading is generated by a drill bit or the like, which is located at the tip of a drill string, with the drill string comprising drilling pipes or an assembly of drilling pipes increasing in length when the drilling heading advances. The drive of the drill bit or another drilling tool occurs here from the earth surface or perhaps from a drilling platform, thus from the surface of the water, with either the drill string serving for the mechanic transmission of the drilling forces or a drilling liquid being pumped into the well, which hydraulically drives the drill bit. Generally, the drill string comprises steel pipes as the drill string so that the drill cuttings developing during the drilling process can be removed by the fluid conducted through the drill string upwards or out of the well. Frequently, a well hole casing is inserted to line the well coaxially in reference to the drill string.

In order to insert the drill string into the well, which becomes increasingly longer with the progress of the drilling process, parts of the drill string, pipeline parts, and the like each typically having a length of 12-20 m are provided in the proximity of the well and successively inserted into the well, with each part newly inserted into the well being fastened to the respectively previous part. The latter commonly occurs via threaded connections at the end of the parts.

Ground drilling normally starts in the vertical direction so that generally a drilling tower is erected, which lowers the individual string parts and the like vertically into the well. A pipe handler ensures the automatic engagement of horizontally aligned parts of the drill string, pipeline parts, etc. and ensures the pivoting of the grasped parts into a vertical position above the well, where it is accepted by the well hole—feeding device at the drilling tower.

The longer the drill string the more important it becomes to keep the time as short as possible for providing and inserting the individual parts to be inserted into the well. Here, the time for handling parts within the period of the overall drilling progress is multiplied here by the fact that from time to time it is necessary to pull the entire drill string out of the well, in order to, for example, replace a worn or damaged drill bit, and thereafter the drill string must once more be inserted into the well by reassembling it part by part. The life of the drill bit can be limited in difficult geological conditions to a few hours so that the pulling out, taking apart, reassembly, and reinsertion of the drill string must be repeated several times, with the number of parts to be handled growing with the progression of the drilling process.

In addition to the time required for handling the individual parts of the drill string, which should be kept as short as possible, it is also important to store the individual parts of a drill string pulled out of a well in an orderly fashion so that they can be reinserted into the borehole in an unchanged sequence. This is particularly of great importance when the drill string requires intermediate parts with particular features or tools at certain positions.

SUMMARY

The present invention is therefore based on the objective to provide a method for managing the parts to be inserted into a well with the support of an electronic data processing system, which particularly reduces the time required for handling the individual parts of a drill string and for assembling them.

This objective is attained in a method as well as an application according to the invention, preferred embodiments of which are described below.

According to the present invention therefore an automatic storage system is provided, particularly comprising stacking bays and/or shelves and at least one shelf operating device to feed a well hole—feeding system with drilling pipes, drilling rods, lining pipes (casings), intermediate parts, drill bits, and the like and/or for restoring respective parts removed from the well hole. Using such automatic storage, resupply, and restorage devices particularly drilling rods, drilling pipes, and lining pipes can be warehoused in a sorted and unambiguously positioned fashion, supplied to the well hole—feeding system, which usually comprises a pipe handler, at the right point of time, and when required be returned to the unambiguously identified and saved positions, from where they can then automatically be fed to the well in the correct sequence.

For this purpose, within the scope of the present invention an electronic data processing system (computing system) is used, in which information is stored regarding the inventory and the updated storage location of parts to be inserted into the well, such as drilling rods, drilling pipes, lining pipes, intermediate parts, drill bits, and the like. Further, information is stored in the computing system regarding the position of installation and/or the sequence of installation of all parts inserted into the well. This way, the computing system is capable to control an automated storage, feeding, and restorage system used according to the invention.

Alternatively or additionally the computing system can also disclose to the user only when and wherefrom which part to be inserted into the well should be fed to the well hole—feeding system, because the computing system knows the storage location of the respective parts and can compare this to the bore list in which it is determined which parts shall successively form the drill string.

It is particularly advantageous to combine a control of an automatic storage, feeding, and restorage device with a display function, in which a drilling list is processed. The user then receives a prompt to feed a certain part from a certain storage location to the well hole—feeding system, if said part cannot be provided in the automatic storage, feeding, and restorage device and/or cannot be handled by said device. The latter particularly applies to drill bits, tools, intermediate parts, and the like. They are then provided in a manual warehouse, with here it being advantageous that their precise location is also known to the computing system according to the invention; this way even in manual operation here a lot of time is saved and/or, more importantly, when returning (the parts) after being pulled out of the well and reinserting them into the drill string the storage of the manually handled parts occurs at a location predetermined by the computing system and can therefore be found by it at a later time.

Within the scope of the present invention it is further preferred for the computing system additionally to have information saved regarding the additional availability of parts removed from the well. This particularly relates to the drill bit or another drilling tool, however it is also advantageous for the computing system to save (events), for example when a defective thread is given, and the two parts concerned must be removed from the drill string in order to allow replacing or repairing them.

This has the particularly advantageous effect in another preferred further development of the method according to the invention, that the computing system notifies (the operator) when the inventory of parts available to insert into the well requires the repairing of parts or a resupply of new parts. This way it is prevented that the drill team surprisingly is faced with the situation that no operational drill bit is available or further drilling is prevented because the drill string cannot be extended any further.

Further preferred within the scope of the present invention additional information is provided in the computing system regarding newly supplied and/or ordered parts to be inserted into the well, which are not yet included in the actual inventory. The information of presently unavailable parts being repaired or located at the maintenance station can be saved within the scope of the computing system. As a result a type of warehousing management system is provided for the parts to be used for a drill string, preferably in combination with a manual warehouse, designed as known from prior art, and an automated warehouse and/or an automatic storage, feeding, and restorage device.

According to another aspect of the present invention an order list is prepared with the type and the number of the parts projected to be inserted into the well and saved in the computing system. Simultaneously information regarding the inventory and the present storage location of the parts to be inserted into the well is stored in the computing system, such as drilling rods, drilling pipes, lining pipes, intermediate parts, drill bits, and the like and perhaps also their availability. According to another aspect of the present invention the computing system based on the present invention can perform a comparison of the order list with the inventory and the present storage location of the parts to be inserted into the well. This way, the existing material as well as preferably its storage location are allocated to the individual items of the order list. This particularly leads advantageously to the computing system being able to display when for processing the order list a repair of parts, a supply of new parts, and/or reorganization or resorting of the warehoused positions is necessary. The latter may represent for example that a certain shipment of several boxes or pallets delivered, containing new parts, can be entered into the automatic storage system in order to ensure the processing of the order list as efficiently as possible. If applicable, it may also allow rearranging of a storage bay or storage shelf in order to ensure processing the order list as fast as possible.

Within this additional aspect of the present invention it is finally advantageous for the order list, if applicable, also allows updating during the drilling operation, which then perhaps may lead to a rearrangement, reorganization, or reordering of parts.

BRIEF DESCRIPTION OF THE DRAWINGS

An example for the implementation of the method according to the invention is described and explained in the following based on the attached drawings. Shown are.

DETAILED DESCRIPTION FO THE PREFERRED EMBODIMENTS

Figure 1:
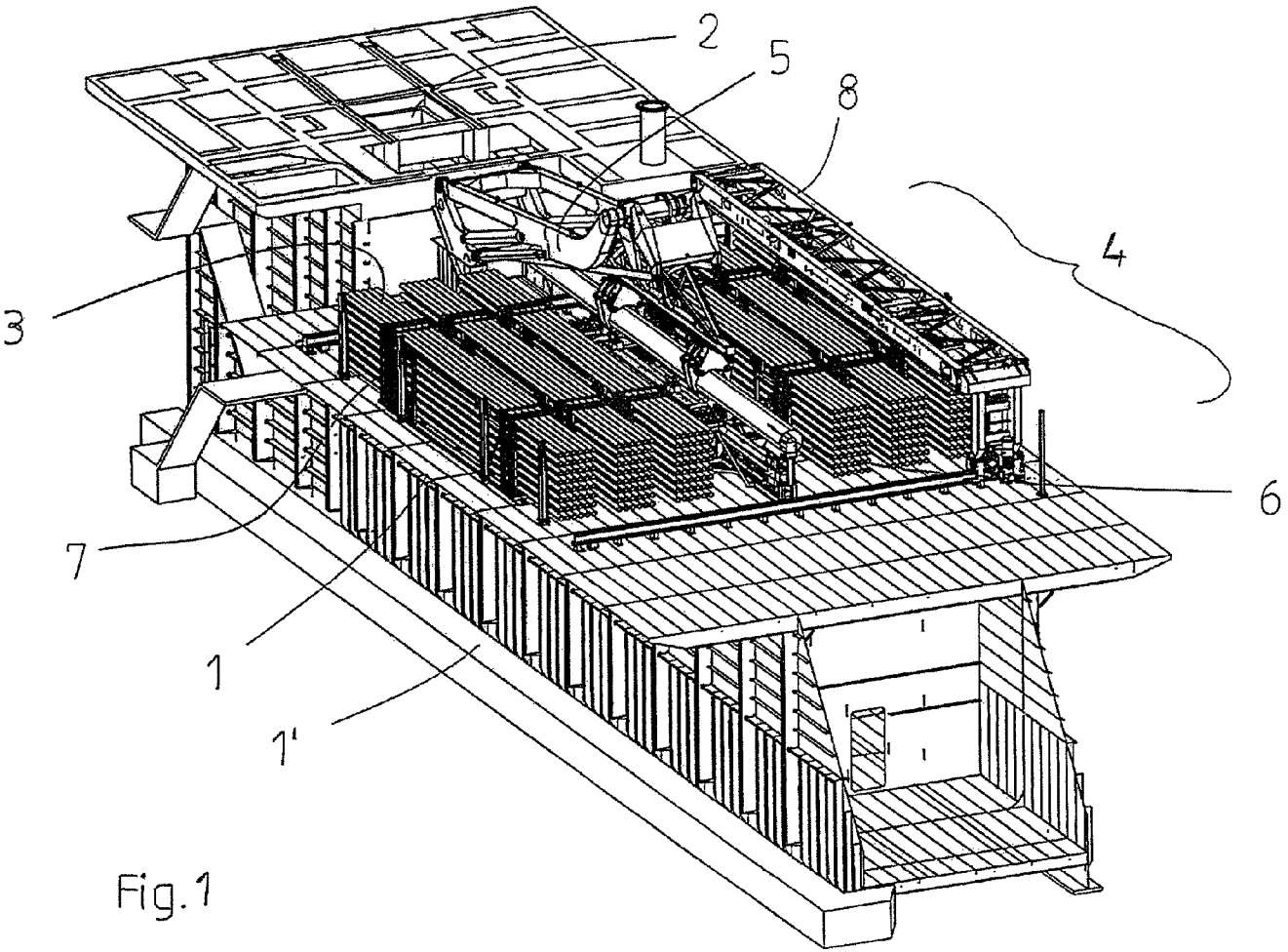
FIG. 1 a view of a section of a drilling platform for offshore applications, in which the method equipped according to the invention is implemented.

FIG. 1 shows a part of a drilling platform for off-shore applications in a schematic perspective view. It comprises two decks 1, 1' of a drilling platform with an opening 2 for a drill strand (not shown, which through the opening 2 is guided vertically downwards through the water to the well in the ground. For this purpose, via the opening 2, a drilling tower (not shown) is used with holding and guiding elements as well as drive devices for the drill strand. At the upper deck 1 of the drilling platform a multitude of drilling pipes 3 are stored in an automatic storage bay 4. In this storage bay 4 the drilling pipes 3 are stored in a horizontal alignment. A pipe handler 5 ensures that the drilling pipes 3 are successively pivoted from a horizontal storage position 6 into a vertical position above the opening 2 in order to allow lowering them by the other elements (not shown) of the well hole—supply system through the opening 2 into the well.

Figure 2:
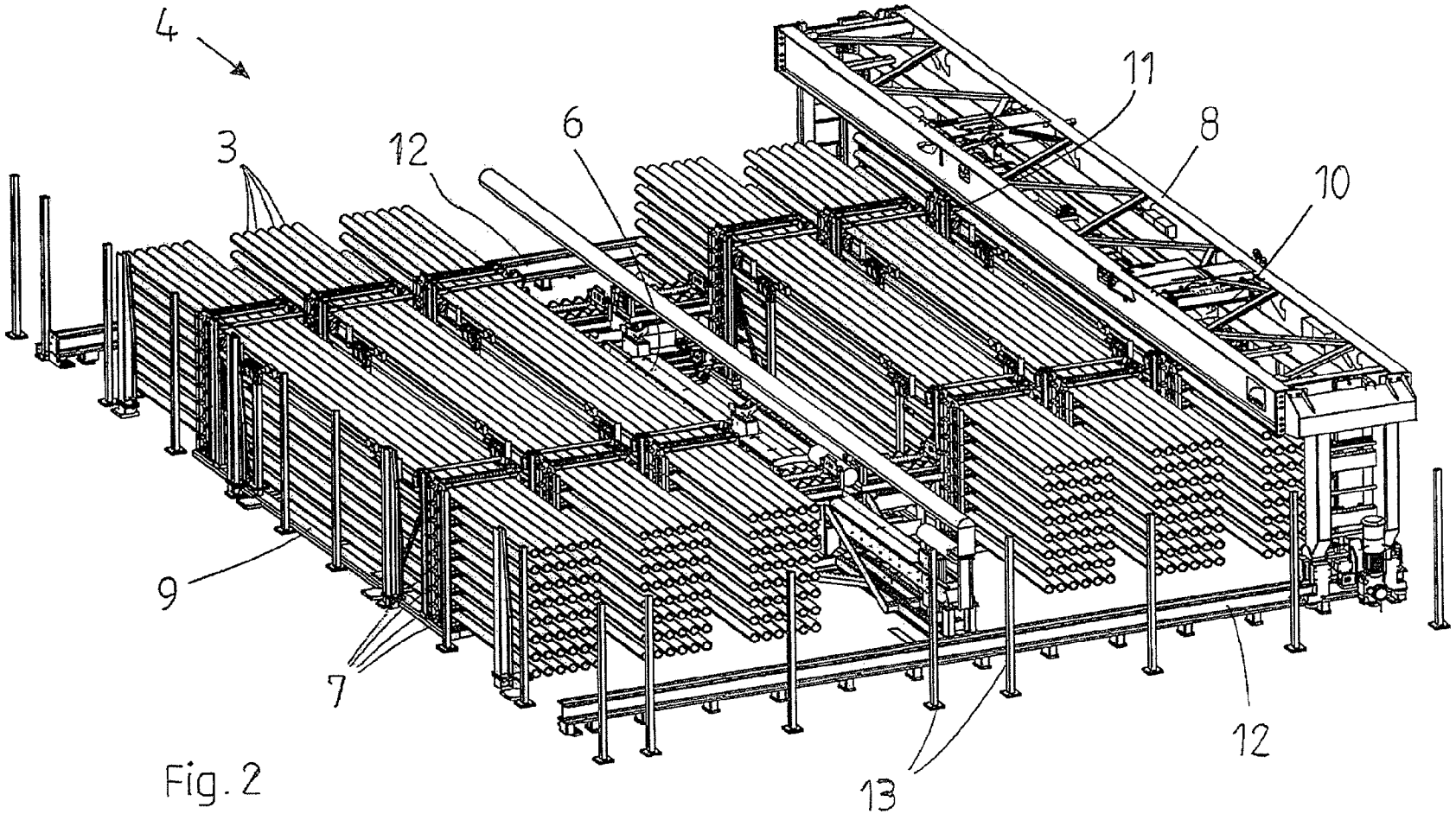
FIG. 2 is an enlarged section of FIG. 1.

The storage bay 4, here used as a storage, feeding, and restorage device, is shown enlarged in FIG. 2. A discernible here, six drilling pipes 3 each are summarized in two storage bays 7; accordingly they can be grasped by a storage operating device 8 as the a "six-pack" and transported as well as perhaps resorted. Several pairs of storage bays 7 are stacked with drilling pipe-packages in order to form the storage aisles of the storage bay 4; in the given case eight storage bays 7 are stacked over top of each other and such a stack is once more secured and/or summarized via the container transportation frame 9.

The storage operating device 8 essentially comprises, as known per se, a portal crane 10 with a load traverse and grasping elements 11 particularly adjusted to the storage bay 7. It is horizontally displaceable on two driving rails 12 in order to bring the drilling pipes 3 from each position of the storage bay 4 out of the storage position 6 and to allow returning it thereto. An only indicated protective fence 13 protects the automatic storage bay 4 from unauthorized access.

Figure 3:
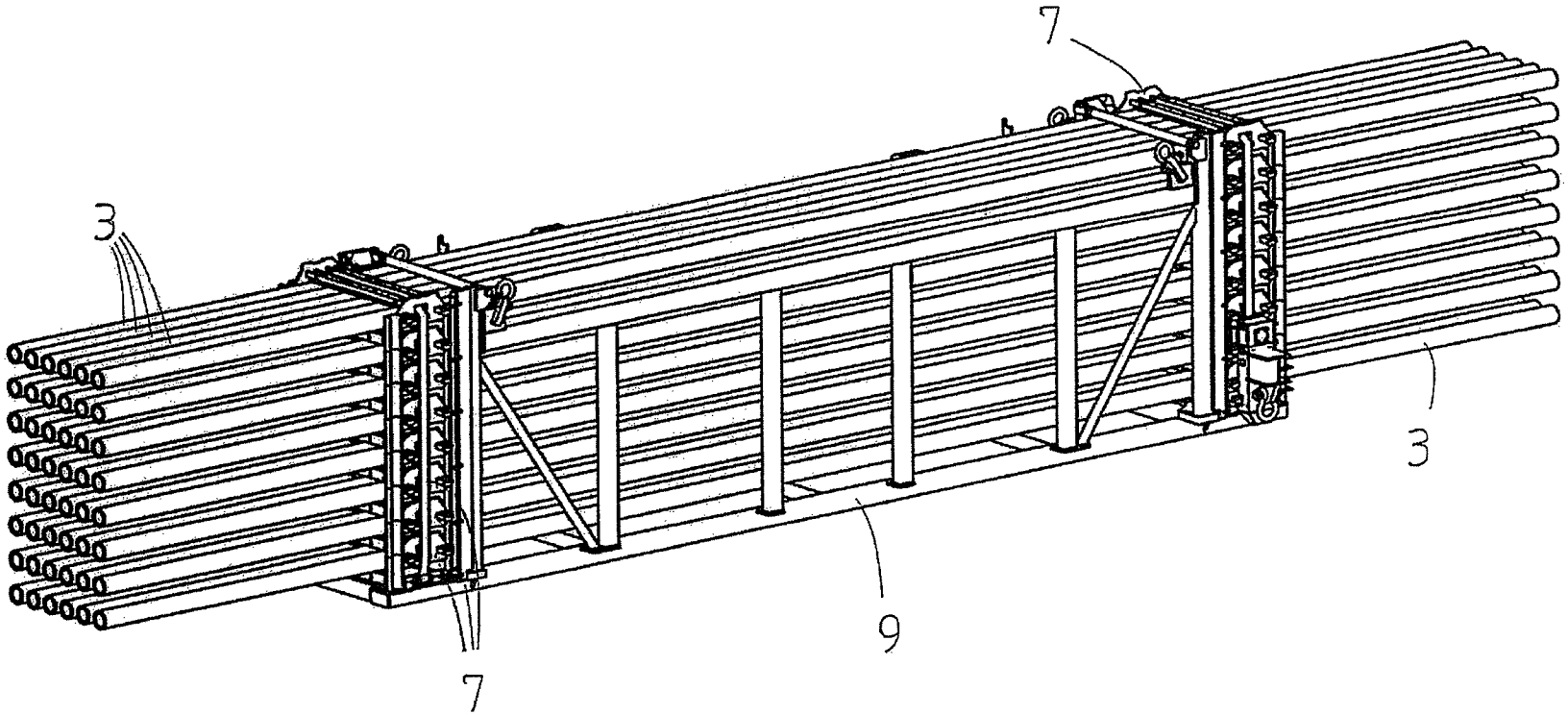
FIG. 3 is a detail from FIG. 2.
Figure 4:
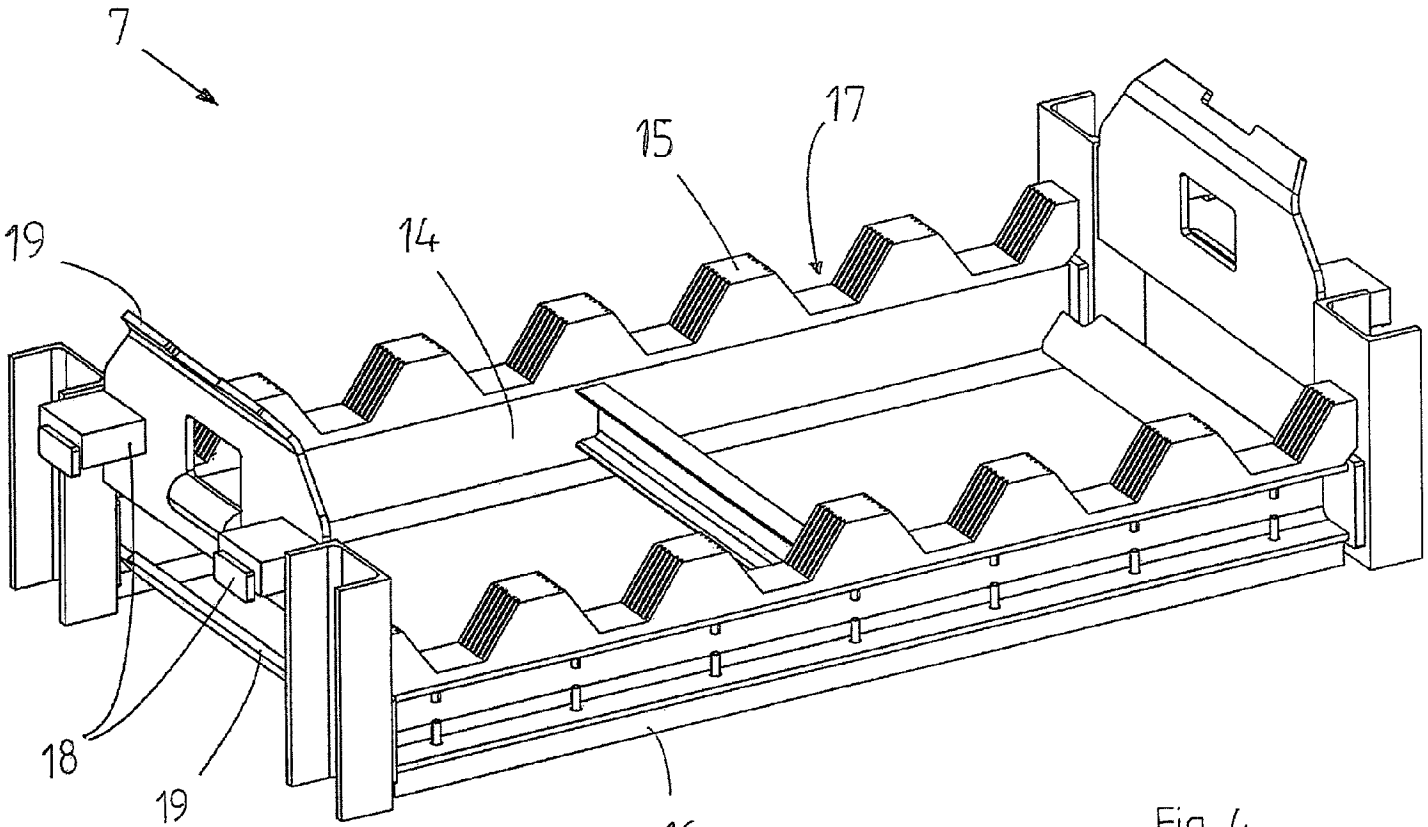
FIG. 4 is a detail from FIG. 3.

FIGS. 3 and 4 show the individual parts of the storage bay 4 in detail, with FIG. 4 illustrating an individual storage bay 7 in a perspective view. This storage bay 7 is known per se, for example from DE 20 2010 002 573 U1. The storage bay 7 used here is adjusted for the use of the present method, though, by one plastic bar 15 comprising prism-shaped cams being provided at the top of the traverses 14 and at the bottom of the clamping bar 16. The clamping bar 16 acts upon a storage bay with drilling pipes arranged underneath the storage bay 7 shown, while the plastic bar 15 forms notches 17, which hold the individual drilling pipes 3 precisely positioned in the storage bay 7. At the face, the storage bays 7 comprise recesses 19 for the grasping elements 11 of the storage operating device 8 as well as insert slopes 19 for the precisely positioned stacking of several stacking bays 7.

FIG. 3 represents a perspective view of a storage bay with eight stacked pairs of bays 7, each combining six drilling pipes 3. This stack of bays is additionally secured by a container transportation frame 9 and forms a storage unit. By the plastic bars 15 (not shown in this illustration) the drilling pipes 3 are exactly positioned in the stacked bays 7 so that a computing system according to the invention can unambiguously allocate the drilling pipes 3 shown here to a matrix with six columns and eight rows. By raising the pair of stacked bays, perhaps with a sequence inverted in reference to the previous sequence, in order to reach a pair of stacked bays located at the bottom, transporting it to the storage position 6, and separating each individual drilling pipe 3 at the storage position it can be selected and fed to the drilling pipe—supply system, here the pipe handler 5. The restorage at an arbitrarily defined position in the storage bay 4 is therefore possible here in a computer-controlled fashion.

Figure 5:
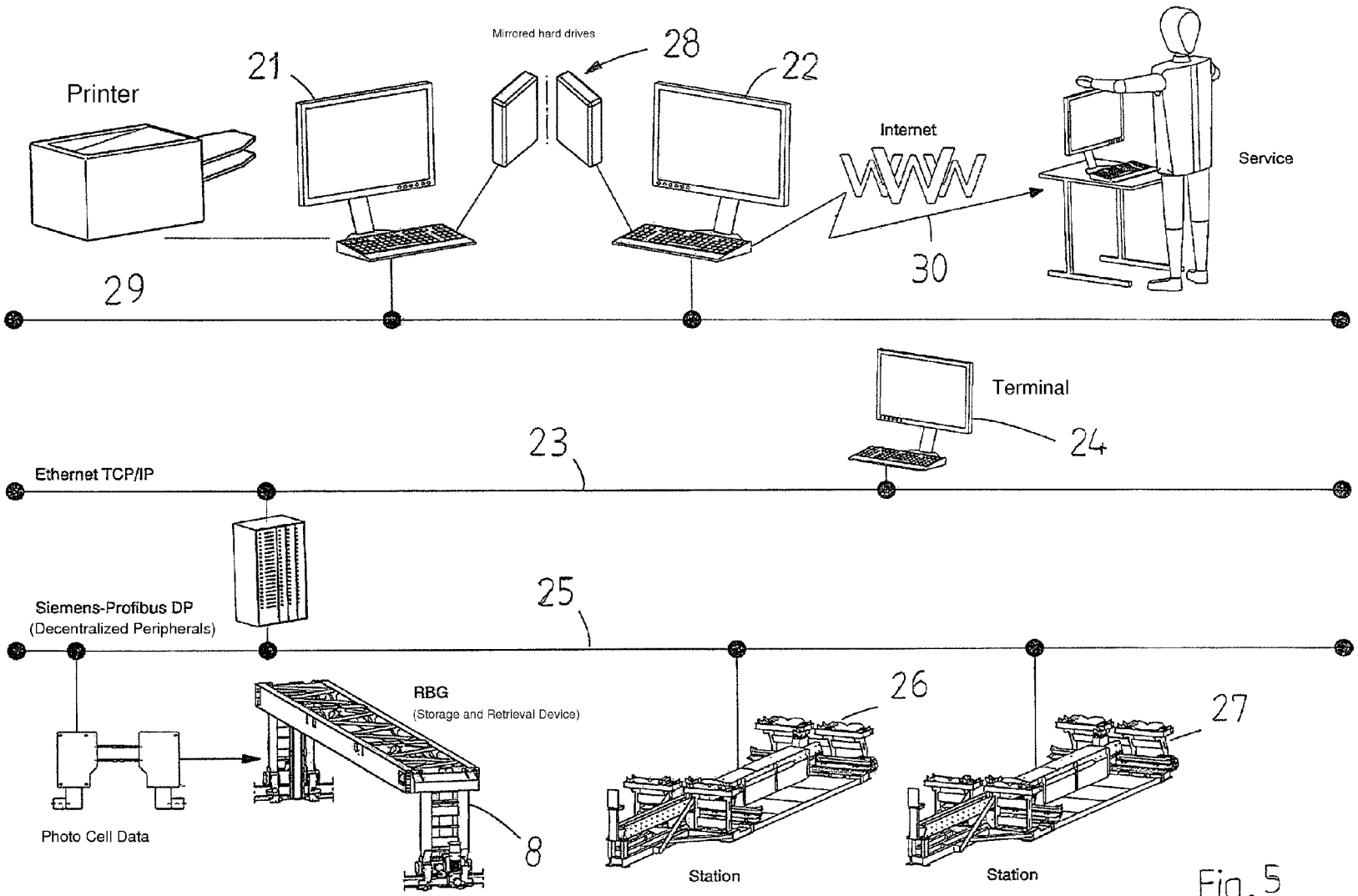
FIG. 5 is a diagram of a computing system for implementing the method according to the method.

FIG. 5 finally shows a schematic diagram of a computing system, which is networked with a storage bay 4 of the previous figures and performs a method embodied according to the invention. A server 21 and a stand-by-server 22 provided as a replacement form the center of the computing system. It is located in a protected room and connected via a network cable 23 to a terminal 24, which is arranged on site on the drilling platform 1 and allows the operation of the system. Via a data bus 25 the storage bay operating device 8 is controlled and data is received therefrom in order to record the updated inventory of drilling pipes 3 in the storage bay 4. Additional connections via the data bus 25 exist to two storage spaces 26, 27, with the storage position 6 (not shown here) for the pipe handler 5 may optionally be supplied, particularly in an alternating fashion. The processing via two storage spaces 26, 27 for pairs of storage bays with content stored there accelerates the handling of the drilling pipes 3 and avoids any delays by the processing time of the storage operating device 8. Storage spaces in which manually handled parts, such as drill bits, intermediate parts, and the like are stored in a more or less orderly fashion, are not shown in FIG. 5, because they are not integrated in the data network.

The connection of the data bus 25 to the server 21 can thus serve for the server 21 always knowing the respectively updated inventory of parts to be inserted into the well and can display this accordingly at the terminal 24. In order to ensure the respective data the server 21 and the stand-by-server 22 are connected to mirrored hard drives 29 as well as a printer 29. If applicable, the server 21 may additionally be connected to the internet so that a remote monitoring or problem solving of potentially occurring problems can be performed online by the system generator.

The terminal 24 processes a list when applying the method according to the invention, in which the individual, unambiguously identified and positioned drilling pipes are listed in a predetermined sequence as well as perhaps the position of intermediate parts and tools. Positions of this list relating to the drilling pipes 3 stored in the storage bay 4 are automatically supplied by the automatic control of the storage bay operating device 8 to the pipe handler 5, while positions in the list relating to parts which are stored in the manual storage spaces 26, 27 generate a stop as well as the generation of an instruction to the operator of the terminal 24 to feed the respective parts to the well hole—supply system and to confirm the performance of this instruction.

If it is necessary to remove the drill strand from the well and here successively disassembly it into its individual parts the server 21 processes the list backwards. During the subsequent restart of the drilling process it is then extremely advantageous that the individual parts are all deposited in a defined position and the server 21 knows these individual positions.

The present exemplary embodiment is furthermore embodied such that the server 21 knows the position of all individual parts provided to be inserted into the well, thus for example also the drilling pipes, stored at a different location on the drilling platform or drilling island, and for example not yet moved into the automated storage bay 4.

The method according to the invention also offers advantages when supply pipes are inserted into the well because in the computing system then even after many years the information is available which part is precisely located at what position of the conveyer strand.

The invention claimed is:

1. A method for managing drilling rods, drilling tools, well tubing, and equipment for ground drilling, for exploring deposits of fossil fuels, geothermal reservoirs, or other wells, comprising:

entering and saving information regarding inventory and present storage locations of parts to be inserted into the well, including at least one of drilling rods, drilling pipes, lining pipes, intermediate parts, and drill bits in a computing system, storing information regarding at least one of an installation position or sequence of assembly of all parts inserted into the well in the computing system, the computing system controlling an automated storage, feeding, and restorage device in which said parts are stored in order to automatically supply said parts to the well or a well hole—supply system, displaying to a user at least one of a location where said parts shall be supplied to the well hole—supply system, when feeding of said parts to the well hole—supply system shall occur, or a restorage location where said parts shall be returned thereto for storage after said parts have been removed from the well; and the computing system combining management of the automated storage, feeding, and restorage device with management of a manual warehouse; with the computing system processing a drilling list; and generating a report that displays to a user said parts to be inserted into the well that are stored in the manual warehouse, which of said parts shall be supplied from which location to the well hole—supply system, and waits for confirmation of the report in order to continue processing the drilling list.

2. A method according to claim 1, wherein a partial quantity of said parts to be inserted into the well or to be removed therefrom is stored in the automated storage, feeding, and restorage device, and information regarding the inventory and the storage location as well as said parts stored in the automatic storage, feeding, and restorage device and parts not stored in said automatic storage, feeding, and restorage device or placed there are saved in the computing system.

3. A method according to claim 2, wherein the computing system additionally stores information regarding the further availability of parts removed from the well.

4. A method according to claim 1, further comprising the computing system indicating when the inventory of available parts to be inserted into the well requires a repair of said parts or procurement of new ones of the parts.

5. A method according to claim 1, wherein additional information is stored in the computing system that indicates whether at least one of newly supplied or ordered parts, not yet included in the inventory of available parts, is to be inserted into the well or is in a repair or maintenance station.

6. A method according to claim 1, wherein the automatic storage, supply, and restorage device comprises an automatic storage system with at least one of storage shelves or storage bays as well as at least one storage operating device.

7. A method for managing drill rods, drilling tools, well tubing, and the like for ground drilling, according to claim 1, wherein the information regarding the inventory and the present storage location of parts to be inserted into the well are saved in the computing system, said parts including at least one of the drilling rods, the drilling pipes, the lining tubing, the intermediate parts, and the drill bits, with an order list with a type and number of said parts to be inserted into the well being saved in the computing system and with the computing system performing a comparison of the order list with the inventory and the present storage location of said parts to be inserted into the well and indicating when for processing the order list a repair of parts, the procurement of new parts, or the reorganization or resorting of the storage positions are necessary.

8. A method according to claim 7, wherein the order list is updateable during the drilling process, as needed.

9. A method according to claim 8, wherein the order list also considers a sequence of said parts probably to be inserted into the well.

10. Using an automatic storage system with at least one of storage bays or shelves and at least one shelf operating device for storing and feeding parts to be inserted into the well, including at least one of the drilling rods, the drilling pipes, the lining tubing, the intermediate parts, the drill bits, in the well hole—supply system as well as for repeated storage of said parts according to the method of claim 1.

* * * * *